United States Patent [19]

Chakrabarty et al.

[11] Patent Number: 4,623,022

[45] Date of Patent: Nov. 18, 1986

[54] WELL SAND PACKING PREVENTION METHOD

[75] Inventors: Tapan Chakrabarty; Ray Thomas, both of Calgary, Canada

[73] Assignee: Exxon Production Research Co., Houston, Tex.

[21] Appl. No.: 678,846

[22] Filed: Dec. 6, 1984

[51] Int. Cl.[4] ..... E21B 43/25

[52] U.S. Cl. ..... 166/310; 252/8.551

[58] Field of Search ..... 166/305 R, 306, 310, 166/307; 252/8.55 R

[56] References Cited

U.S. PATENT DOCUMENTS

| | | | |
|---|---|---|---|
| 2,947,360 | 8/1960 | Bernard | 166/9 |
| 3,155,160 | 11/1964 | Craig, Jr. et al. | 166/303 |
| 3,396,792 | 8/1968 | Muggee | 166/303 |
| 4,158,521 | 6/1979 | Anderson | 405/264 |
| 4,366,071 | 12/1982 | McLaughlin | 252/8.55 R |
| 4,366,073 | 12/1982 | McLaughlin et al. | 166/305 R X |
| 4,366,074 | 12/1982 | McLaughlin | 252/8.55 R |
| 4,374,739 | 2/1983 | McLaughlin et al. | 166/305 R X |
| 4,393,939 | 7/1983 | Smith | 166/293 |

*Primary Examiner*—Stephen J. Novosad
*Assistant Examiner*—Thomas J. Odar
*Attorney, Agent, or Firm*—D. H. Vickrey

[57] ABSTRACT

A method for producing hydrocarbons from a subterranean formation which reduces sand packing in a producing well completed in a zone adjacent the hydrocarbon-bearing formation. The method includes the steps of producing a fluid from the formation which contains both a hydrocarbon phase and an aqueous phase, and simultaneously therewith, injecting a sand control agent, such as a quarternized acylated condensed alkanolamine, into the well adjacent the production zone at a rate to obtain a wellhead concentration of the agent in the aqueous phase in the produced fluid effective to flocculate the concomitantly produced sand particles. The sand particles so treated have a reduced tendency to pack in the well bore and are safely produced with the formation fluids. The method may be practiced in conjunction with conventional sand control techniques, or may be employed as the sole means of sand control.

12 Claims, No Drawings

WELL SAND PACKING PREVENTION METHOD

FIELD OF THE INVENTION

This invention pertains to the production of hydrocarbon fluids from subterranean formations, and particularly to sand control techniques employed in such production.

BACKGROUND OF THE INVENTION

The concomitance of sand production with hydrocarbon production from subterranean formations is a well known problem. In many types of formations from which hydrocarbon fluids are produced, fine sand particles are concomitants. The concomitant sand particles include both load-bearing solids which are part of the mechanical structure of the formation and fine solids, associated with formation fluids, which are not part of the formation structure. Such particles exhibit a natural tendency to attach to the exposed formation faces and inside the production tubing and other down-well equipment and accumulate, building up packed, cohesive masses at the sites of attachment. This process is known as sand packing. When enough of the particles have so accumulated, flow of fluids produced from the formation may be restricted by the packed sand, or the packed sand aggregates may break off and, if sufficiently large, either settle to the bottom of the well causing sandup, or, if entrained in the fluid traveling up the well, plug the well at a restricted flow location. In either case, hydrocarbon production is impaired, requiring well cleanout and possible formation damage.

The three basic types of sand control techniques heretofore known include drag force reduction, mechanical methods and formation consolidation. Frictional forces of the fluid moving through the formation causes sand movement. Sand movement can be reduced by increasing the flow area, as by providing large perforations, increasing the perforation density or fracturing the formation. Alternatively, the drag forces can be reduced by reducing the fluid production rate. Mechanical sand control techniques include gravel packing or installation of sand screens or a slotted liner. Formation consolidation involves the injection and uniform precipitation of a resin in the sand near the well bore. Many of these techniques are expensive or have applications limited by the type of formation. In addition, even when these techniques are employed, fines are almost always produced. If such fines are not produced, they can eventually block the flow channels in the formation, necessitating expensive remedial measures.

Another approach to treating subterranean formations has involved the injection of cations into the formation to prevent the swelling of clays therein. For example, in U.S. Pat. Nos. 4,374,739, 4,366,074 and 4,355,071, there is described the treatment of clay-containing formations with polycationic polymers including alkyl polycationic polymers, heteroaliphatic polycationic polymers containing rings and pendent polycationic polymers. As described in U.S. Pat. No. 4,393,939, similar cationic polymers have been included in well drilling and cementing fluids to minimize the destabilizing effects due to the water contained in such fluids which penetrates into the formation. Similar treatment of a formation with a solution of an oxygenated polyamine, a reaction product of dimethylamine and epichlorohydrin, is described in U.S. Pat. No. 4,158,521. Formation treatments with solutions of coordination compounds of metals with alkyl polyamines are described in U.S. Pat. No. 2,947,360. Stabilization of the producing formation in the vicinity of the borehole or by means of stabilizing agents added to a waterflood, as with the aforementioned sand control techniques, cannot totally eliminate production of the fine particles associated with the formation fluids produced from the untreated portion of the producing formation.

SUMMARY OF THE INVENTION

Briefly, the invention is a method for preventing sand accumulation in a producing well which is completed in a zone adjacent a hydrocarbon-bearing subterranean formation. The method is generally applicable to wells in which the fluid produced contains an aqueous phase, and includes the steps of (a) producing fluid from the hydrocarbon-bearing formation, and (b) simultaneously therewith, injecting a sand control agent into the fluid produced from the formation in the well adjacent the production zone at a rate to provide a wellhead concentration of sand control agent in the aqueous phase of the produced fluid effective to flocculate the sand particles to reduce sand packing. Treatment of a production well in accordance with the method reduces the tendency of sand particles to pack, thus allowing concomitant sand particles to be safely produced by entrainment with the well production fluids, thus preventing sand packing of the production well.

The method is generally applicable to all wells, whether or not conventional sand control techniques are employed, which produce fluids containing dispersed interstitial fines associated with formation fluids. Thus, it is contemplated that the method may be employed in conjunction with conventional sand control techniques, or as the sole method of sand control.

DETAILED DESCRIPTION OF THE INVENTION

In producing fluids from the formation, conventional methods and equipment which are well known to those in the oil and gas industry are employed.

The sand control agent is injected into the well bore by means of a pipe, tube or other suitable conduit in fluid communication between the well bore adjacent the production zone and a source located at the surface for supplying the sand control agent. Conventional mixing, pumping and metering equipment may be employed to inject the sand control agent into the well, either as a neat solution or diluted. The sand control agent is thus metered into the production zone at a rate which is proportional to the production rate at which the well is operated to provide a wellhead sand control agent concentration in the aqueous phase of the produced fluids sufficient to flocculate the sand particles. The flocculated sands pack to a lesser extent than dispersed sands and are thus more readily entrained in and produced with the aqueous phase of the fluid produced from a hydrocarbon-bearing formation. The sand control agent may be metered into the production zone on a continuous basis or during intermittent periods after a produced fluid demonstrates that sand packing is beginning.

The compounds useful as sand control agents in this method include chemicals commonly employed in aqueous systems as oil-in-water demulsifiers. Such additives, when mixed in the well bore with the fluid produced from the formation, become dissolved in or mixed with the aqueous phase thereof. These agents tend to promote the flocculation or agglomeration to each other of sand particles produced from the formation. It has been discovered that particles so treated have a reduced tendency to pack in the well bore at the exposed formation faces or in the production tubing string.

Preferably, the sand control agent employed is also commonly utilized as a demulsifier in surface processing equipment, such as oil-water separators. Thus, the method has a further advantage in that there is a reduced need to add demulsifiers to the fluids in the surface processing. Further, the flocculated or agglomerated particles are more easily removed and processed in surface separating equipment than are the dispersed particles.

An especially preferred class of sand control agents is quarternized acylated condensed alkanolamine of the formula

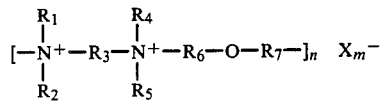

wherein $R_3$, $R_6$ and $R_7$ are independently aryl, alkyl or arylalkyl, $R_1$, $R_2$, $R_4$ and $R_5$ are independently hydrogen or alkyl containing 1–6 carbon atoms, X in an anion selected from the group consisting of halide, nitrate, sulfate, hydroxide and combinations thereof, n is an integer equal to the number of monomer units required to give a polymer with a molecular weight of from about 3,000 to about 4,000, and m is an integer equal to the number of anions required to maintain electronic neutrality. These compounds are commercially available as demulsifiers, such as, for example, demulsifiers sold under the trade designations EBC-1 by Buckman Laboratories, Memphis. Tenn., and Tretolite J-118 by Petrolite, Inc. Of the compounds of this class, a quarternized acylated condensed alkanolamine according to the above formula, wherein $R_3$, $R_6$ and $R_7$ are ethyl, $R_1$, $R_2$, $R_4$ and $R_5$ methyl and X is chloride, available under the trade name EBC-1, is especially preferred because of its excellent ability to flocculate dispersed formation solids at relatively low concentrations.

The sand control agent must be metered into the produced fluid at a rate effective to flocculate the sand particles, typically at an aqueous concentration of from about 10 to about 1,000 ppm active. When the demulsifier EBC-1 is employed as the sand control agent, best results are obtained when the wellhead sand control agent concentration in the aqueous phase of the produced fluids is from about 20 to about 100 ppm active, preferably 30 ppm. Because such compounds are typically obtained commercially in the form of a concentrated aqueous solution, the term "gross" is used for convenience herein to refer to the concentr-ation of the commercial solution in the treated fluid, and the term "active" to refer to the concentration of the compound in the treated fluid.

Examples 1–5 are provided below to further illustrate the current invention. The results of the tests performed in Examples 1–5 are summarized in Table 1.

EXAMPLE 1

Three cylinders were prepared, each containing 10 g of deoiled Cold Lake Type 3 sands and 90 g of distilled water. Cylinder No. 1 served as a control to which no sand control agent was added. A corrosion inhibitor, known by the trade designation SC-60SW, was added to Cylinder No. 2 to obtain a concentration of 100 ppm gross, 30 ppm active in the aqueous phase. SC-60SW is a mixture of primary fatty amines and is available from Petrol, Inc. Cylinder No. 3 contained 60 ppm gross, 30 ppm active, of Tretolite J-118, a mixture of quarternized acylated condensed alkanolamines obtained from Petreco Division of Petrolite, Inc. The cylinders were then shaken vigorously. Flocculation of sand particles was noted in Cylinder No. 3, but not in Cylinder Nos. 1 or 2. The time-invariant volumes of packed sands in Cylinder Nos. 2 and 3 were compared with that in Cylinder No. 1. No increase in the volume of packed sands was observed in Cylinder No. 2. Cylinder No. 3 had a 21% greater volume of packed sands than Cylinder No. 1, demonstrating a reduced tendency of the sand to pack. The degree of sand packedness in the three cylinders was also tested by tilting the cylinders. It was found that sands treated with Tretolite J-118 demulsifier were very loosely packed while the sands treated with Petrol SC-60SW were as tightly packed as the untreated sands. It was also noticed that the water in Cylinder No. 3 was much clearer than that in Cylinder Nos. 1 and 2.

EXAMPLE 2

Three cylinders (Cylinder Nos. 4, 5 and 6) were prepared as in Example 1, Cylinder No. 4 containing no additives. Cylinder No. 5 contained 60 ppm gross, 30 ppm active, of Tretolite J-118 demulsifier. Cylinder No. 6 contained 30 ppm active, 300 ppm gross, of EBC-1 demulsifier. Upon shaking as in Example 1, flocculation was observed in both Cylinder Nos. 5 and 6. The water in Cylinder No. 6 was much clearer than that in Cylinder No. 5. The volume of packed sands in Cylinder No. 5 was 30% greater than that in Cylinder No. 4, and the volume increase in Cylinder No. 6 was 62% greater than that in Cylinder No. 4.

EXAMPLE 3

Using powdered silica instead of Cold Lake sands, three cylinders (Cylinder Nos. 7, 8 and 9) were prepared as in Examples 1 and 2, Cylinder No. 7 containing no additives. Cylinder No. 8 contained 30 ppm active, 100 ppm gross, Petrol SC-60SW. Cylinder No. 9 contained 30 ppm active, 60 ppm gross, Tretolite J-118 demulsifier. No flocculation was observed in any of the cylinders, nor any increase in the volume of packed sands. Upon addition of 0.1 g of sodium montmorillonite to Cylinder Nos. 8 and 9 and agitating, flocculation was observed in Cylinder No. 9. The water in Cylinder No. 8 had the appearance of a colloidal suspension; however, no increase in the volume of packed sands was noticed. A 78% volume increase was observed in Cylinder No. 9. On inversion of the cylinders, it was observed that almost all of the sands remained stuck to the bottom of Cylinder No. 8, while most of the sands in Cylinder No. 9 fell to the bottom. This example shows Tretolite J-118 demulsifier induced flocculation in the presence of very small amounts of sodium montmorillonite, resulting in very loosely packed sands. In contrast, Petrol SC-60SW did not induce flocculation nor did it reduce the sand packing.

Since flocculation of sand particles appeared to be the dominant mechanism in reducing packing of sands in these tests, $Al_2(SO_4)_3.18H_2O$ was added to Cylinder No. 8 at 250 ppm. Flocculation was observed immediately with a 61% increase in the volume of packed sands.

EXAMPLE 4

Two cylinders were prepared as in the above examples using Cold Lake Type 1 tar sands and Cold Lake produced water. Type 1 tar sands usually contain more hydrocarbons and less fines than Type 3 tar sands. Generally, Type 1 tar sands contain about 10–14 wt. percentage hydrocarbons while Type 3 tar sands contain about 4–6 wt. percentage hydrocarbons. Cylinder No. 10 contained no additives and Cylinder No. 11 contained 60 ppm active, 200 ppm gross, of Petrol SC-60SW. Upon shaking and allowing the sands to settle, the volume of packed sands in Cylinder Nos. 10 and 11 was essentially the same. Upon addition of 30 ppm active, 60 ppm gross, of Tretolite J-118 demulsifier to Cylinder No. 10, an increase of 35% in the volume of packed sands was noticed.

EXAMPLE 5

Three cylinders were prepared as in Example 4. Cylinder No. 12 contained no additives; Cylinder No. 13, 30 ppm active, 100 ppm gross, of Petrol SC-60SW; and Cylinder No. 14, 30 ppm active 60 ppm gross, of Tretolite J-118 demulsifier. The volume of packed sands in Cylinder No. 13 was 7% greater than that in Cylinder No. 12, while the increase was 25% in Cylinder No. 14.

TABLE 1

| | Sand Type | Sand Control Agent | Observations |
|---|---|---|---|
| Example 1 | | | |
| Cylinder No. 1 | Type 3 Tar Sand | None | Cloudy water. Packed sands. |
| Cylinder No. 2 | Type 3 Tar Sand | SC-60SW | Cloudy water. Packed sands. |
| Cylinder No. 3 | Type 3 Tar Sand | Tretolite J-118 | Clear water. Sand volume 21% greater than Cylinder No. 1. |
| Example 2 | | | |
| Cylinder No. 4 | Type 3 Tar Sand | None | Packed sands. |
| Cylinder No. 5 | Type 3 Tar Sand | Tretolite J-118 | Sand volume 30% greater than Cylinder No. 4. |
| Cylinder No. 6 | Type 3 Tar Sand | EBC-1 | Clear water. Sand volume 62% greater than in Cylinder No. 4. |
| Example 3 | | | |
| Cylinder No. 7 | Powdered Silica | None | Packed sands. |
| Cylinder No. 8 | Powdered Silica | SC-60SW | Packed sands. |
| Cylinder No. 8 (Second Addition) | Powdered Silica | SC-60SW Sodium montmorillonite | Packed sands. |
| Cylinder No. 8 (Third Addition) | Powdered Silica | SC-60SW, sodium montmorillonite and $Al_2(SO_4)_3.18H_2O$ | 61% sand volume increase after addition of $Al_2(SO_4)_3.18H_2O$. |
| Cylinder No. 9 | Powdered Silica | Tretolite J-118 | Packed sands. |
| Cylinder No. 9 (Second Addition) | Powdered Silica | Sodium montmorillonite | Sand volume 78% greater than Cylinder No. 7. |
| Example 4 | | | |
| Cylinder No. 10 | Type 1 Tar Sand | None | Packed sands. |
| Cylinder No. 11 | Type 1 Tar Sand | SC-60SW | Packed sands. |
| Cylinder No. 10 (Second addition) | Type 1 Tar Sand | Tretolite J-118 | 35% sand volume increase after addition of Tretolite J-118. |
| Example 5 | | | |
| Cylinder No. 12 | Type 1 Tar Sand | None | Packed sands. |
| Cylinder No. 13 | Type 1 Tar Sand | SC-60SW | Sand volume 7% greater than Cylinder No. 12. |
| Cylinder No. 14 | Type 1 Tar Sand | Tretolite J-118 | Sand volume 25% greater than Cylinder No. 12. |

The current invention provides a method for reducing sand packing in a producing well in a hydrocarbon formation. In the method, a sand control agent, such as a quarternized condensed alkanolamine, is injected into the well during the production of a hydrocarbon phase and an aqueous phase from the formation. The sand control agent causes the suspension of produced sand particles in the produced aqueous phase, thereby reducing sand packing and sand buildup in the well.

While the invention is described above, many other variations will occur to those skilled in the art. It is intended that all such variations which fall within the scope and spirit of the appended claims be embraced thereby.

What we claim is:

1. A method of preventing sand packing in a producing well completed in a zone adjacent a hydrocarbon-bearing subterranean formation, comprising the steps of:

producing fluid from the hydrocarbon-bearing formation, said fluid comprising an aqueous phase and a hydrocarbon phase; and, simultaneously with said fluid production, injecting a sand control agent into the well adjacent the production zone at a rate to obtain a wellhead concentration of said sand control agent in said aqueous phase of said fluid of from about 10 to about 1000 ppm active, wherein said sand control agent is a quarternized acylated condensed alkanolamine of the formula:

$$[-\underset{R_2}{\overset{R_1}{N^+}}-R_3-\underset{R_5}{\overset{R_4}{N^+}}-R_6-O-R_7-]_n X_m$$

wherein $R_3$, $R_6$ and $R_7$ are independently aryl, alkyl or arylalkyl, $R_1$, $R_2$, $R_4$ and $R_5$ are independently hydrogen or alkyl containing 1–6 carbon atoms, X is an anion selected from the group consisting of halide, nitrate, sulfate, hydroxide and combinations thereof, n is an integer equal to the number of monomer units required to give a molecular weight of from about 3,000 to about 4,000, and m is an integer equal to the number of anions required to maintain electronic neutrality.

2. The method of claim 1 wherein $R_3$, $R_6$ and $R_7$ are ethyl, $R_1$, $R_2$, $R_4$ and $R_5$ are methyl, and X is chloride.

3. The method of claim 2 wherein said concentration is from about 20 to about 100 ppm active.

4. The method of claim 3 wherein said concentration is about 30 ppm active.

5. The method of claim 1 wherein the method is employed as the sole method of sand control.

6. The method of claim 1 wherein the method is employed in conjunction with conventional sand control techniques.

7. The method of claim 1 wherein said sand control agent is injected on a continuous basis.

8. The method of claim 1 wherein said sand control agent is injected on an intermittent basis.

9. A method of preventing sand packing in a producing well with a well bore completed in a zone adjacent a hydrocarbon bearing subterranean formation, comprising the steps of:

producing fluid from the hydrocarbon-bearing formation, said fluid comprising an aqueous phase, a hydrocarbon phase, and concomitant sand particles; and simultaneously with said fluid production, metering a demulsifier into a conduit in fluid communication with the well bore adjacent the production zone at a rate to provide an aqueous wellhead concentration of said demulsifier in said aqueous phase of from about 10 to 1000 ppm active wherein said demulsifier is a quarternized acylated condensed alkanolamine of the formula:

$$[-\overset{R_1}{\underset{R_2}{N^+}}-R_3-\overset{R_4}{\underset{R_5}{N^+}}-R_6-O-R_7-]_n X_m$$

wherein $R_3$, $R_6$ and $R_7$ independently aryl, alkyl or arylalkyl, $R_1$, $R_2$, $R_4$ and $R_5$ are independently hydrogen or alkyl containing 1–6 carbon atoms, X is an anion selected from the group consisting of halide, nitrate, sulfate, hydroxide and combinations thereof, n is an integer equal to the number of monomer units required to give a molecular weight of from about 3,000 to about 4,000, and m is an integer equal to the number of anions required to maintain electronic neutrality.

10. The method of claim 9 wherein $R_3$, $R_6$ and $R_7$ are ethyl, $R_1$, $R_2$, $R_4$ and $R_5$ are methyl, and X is chloride.

11. The method of claim 10 wherein said concentration is from about 20 to about 100 ppm active.

12. The method of claim 11 wherein said concentration is about 30 ppm active.

* * * * *